US009376246B2

(12) United States Patent
Jones et al.

(10) Patent No.: US 9,376,246 B2
(45) Date of Patent: Jun. 28, 2016

(54) BLISTER PACKAGING

(71) Applicant: MeadWestvaco Calmar, Inc., Richmond, VA (US)

(72) Inventors: Marty Jones, Glen Allen, VA (US); Ryan A. Bailey, Richmond, VA (US)

(73) Assignee: WestRock Dispensing Systems, Inc., Norcross, GA (US)

( * ) Notice: Subject to any disclaimer, the term of this patent is extended or adjusted under 35 U.S.C. 154(b) by 0 days.

(21) Appl. No.: 13/965,757

(22) Filed: Aug. 13, 2013

(65) Prior Publication Data

US 2015/0048000 A1 Feb. 19, 2015

(51) Int. Cl.

| | |
|---|---|
| ***B65D 75/36*** | (2006.01) |
| ***B65D 77/04*** | (2006.01) |
| *B65D 5/38* | (2006.01) |

(52) U.S. Cl.

CPC ..... *B65D 75/368* (2013.01); *B65D 75/367* (2013.01); *B65D 77/0433* (2013.01); *B65D 5/38* (2013.01)

(58) Field of Classification Search

CPC ..... B65D 5/38; B65D 50/045; B65D 50/046; B65D 83/0463; B65D 75/327; B65D 2215/02; B65D 83/04; B65D 85/42; A45C 13/10; A45C 13/18

USPC ..... 206/1.5, 528–532, 538, 539; 229/125.125

See application file for complete search history.

(56) References Cited

U.S. PATENT DOCUMENTS

| | | | | |
|---|---|---|---|---|
| 6,641,031 | B2 * | 11/2003 | Evans et al. | 206/532 |
| 7,658,287 | B2 * | 2/2010 | Hession | 206/528 |
| 7,845,496 | B2 * | 12/2010 | Hession | 206/538 |
| 8,011,512 | B2 * | 9/2011 | Brollier et al. | 206/531 |
| 8,235,204 | B2 * | 8/2012 | Loughman et al. | 206/1.5 |
| 8,490,794 | B2 * | 7/2013 | Kalin et al. | 206/528 |
| 8,499,936 | B2 * | 8/2013 | Albrecht et al. | 206/528 |
| 8,939,281 | B2 * | 1/2015 | Matsuba et al. | 206/1.5 |
| 9,174,780 | B2 * | 11/2015 | Gelardi | B65D 83/0463 |
| 2009/0134054 | A1 * | 5/2009 | Lee et al. | 206/531 |
| 2010/0230320 | A1 * | 9/2010 | Caron et al. | 206/531 |

* cited by examiner

*Primary Examiner* — Bryon Gehman

(74) *Attorney, Agent, or Firm* — WestRock Intellectual Property Group

(57) ABSTRACT

A blister package including an outer sleeve and a blister receptacle, the blister package having retention panel supporting mechanisms proximate an end of the blister receptacle to support the blister package in the outer sleeve when the blister package is almost completely withdrawn from the outer sleeve and may include one or more locking mechanisms to prevent unwanted opening of the blister package or disengagement of the blister package from the outer sleeve.

12 Claims, 7 Drawing Sheets

BLISTER PACKAGING

BACKGROUND OF THE INVENTION

1. Field of the Invention

The present invention relates generally to packaging, such as blister or sleeve-and-drawer style packages for consumer goods for home and laundry care type applications such as liquid-tabs or pods for laundry detergent, dishwasher detergent, other cleaning agents and the like, food items, toys, hardware, and electrical items and high-value items, such as consumer electronics and the like, that are provided in unit dose or individual portions. More specifically, but not exclusively, the invention relates to lockable sleeve-and-drawer style packaging having an internal slidable receptacle, that is releasably lockable within an outer sleeve which may provide a child-resistant, senior-friendly package for items dispensed individually over time.

2. State of the Art

In the field of packaging, particularly in the field of home-care and laundry care products, quantities of detergents and cleaning agents are often supplied in individual portions. For example, laundry detergent is now often supplied in unit dose "pods" or "liquid-tabs". Multiple "pods" are typically provided in re-sealable pouches or lidded boxes so that a user can dispense individual items over a period of time. However, these items may be harmful if ingested by a child or pet and it is recognized that it would be beneficial to provide packaging for such items that is more secure or more child resistant.

It is already known in the field of healthcare and medication packaging to provide consumers or patients with sleeve-and-drawer style secure packaging that has child-resistant features to restrict or prevent access to the package contents by a child. Typically the contents are small-sized pharmaceuticals, such as capsules, tablets and drugs contained in blister packs for unit-dose type dispensing. At the same time, it is useful for the intended user to be able to access the products contained within the package with some degree of ease. As such it is beneficial if the packaging is also "senior-friendly". Many packages are available that comprise an inner slide card or drawer that holds articles in blisters or in trays. The inner slide card, with the articles, is then slidable inside an outer sleeve. The inner slide card is usually retained and locked inside the outer sleeve by a locking flap that engages the outer sleeve. An unlocking mechanism is usually provided on the outer sleeve to permit the disengagement of the inner slide card from the outer sleeve. Such unlocking mechanisms often require some dexterity to operate or require user realization that coordinated operation of more than one feature is required; this may make the package child-resistant. In some instances, this may also make the package less senior-friendly than is desirable. It may be desirable to assist an authorized user of the package with accessing the package products.

It has been recognized that such lockable packaging would be beneficial for securing bulkier or larger sized items such as laundry pods and the like, either for facilitating their containment and individual dispensing over time and/or for child-resistant and/or security reasons. Further considerations in the development of such unit-dispensing sleeve-and-drawer style packages are the need for such packages to be repeatedly opened, re-closed and optionally locked and unlocked many times without failure. It is also desirable to keep the cost of the packaging as low as possible, whilst maintaining its durability. A further consideration is that the size of the package relative to the size of the products being packaged is preferably minimized, not only to reduce its production costs by using less material, but also to reduce shipping costs.

BRIEF SUMMARY OF THE INVENTION

According to certain embodiments of the invention, there is provided a package comprising an outer sleeve and a lockable receptacle, the lockable receptacle comprising a main body having one or more product-holding blisters and the outer sleeve providing a cavity for the lockable receptacle having a closed or closeable rear end and an open or openable front end through which the lockable receptacle may be inserted and through which the lockable receptacle may be withdrawn, the package comprising a stopping mechanism for preventing the lockable receptacle from being fully withdrawn from the outer sleeve, the first part of the stopping mechanism being formed as part of the outer sleeve and being disposed proximate the front end thereof, the second part of the stopping mechanism being formed as part of the lockable receptacle and being disposed proximate a rear end thereof, wherein the lockable receptacle additionally comprises a supporting mechanism formed proximate to the second part of the stopping mechanism for ensuring proper co-operation of the first and second parts of the stopping mechanism and wherein the supporting mechanism comprises one or more retention panels depending from the main body of the lockable receptacle.

Optionally, the one or more retention panels are connected via one or more hinge connections to the main body of the lockable receptacle.

Optionally, the one or more hinge connections are living hinge connections.

Optionally, one or more product-holding blisters that are disposed closest to the second part of the stopping mechanism formed on the lockable receptacle are defined as rear-most product-holding blisters and wherein said one or more retention panels depending from the main body of the lockable receptacle overlap at least a part of the rear-most product-holding blister.

In some embodiments, the one or more product-holding blisters may be integrally formed product-holding blisters. Said one or more product-holding blisters may have a depth of between about 3 cm and about 5 cm. The one or more retention panels may have a depth of between about 3 cm and about 5 cm.

Optionally, the one or more retention panels may have the same depth as the one or more product-holding blisters.

Optionally, the package comprises two oppositely positioned retention panels.

The first part of the stopping mechanism may be a folded front end flap provided on the outer sleeve. The second part of the stopping mechanism may comprise a foldable locking foot.

The foldable locking foot may be an integrally formed part of the lockable receptacle or the foldable locking foot may be provided by an auxiliary slide card affixed to the main body of the lockable receptacle that has the one or more product-holding blisters.

Optionally, the lockable receptacle is generally a molded plastic construct comprising a product in each of said one or more product-holding blisters and having a sealing film disposed to cover and seal each of the one or more product-holding blisters.

According to some embodiments of the invention, products positioned in the one or more blisters may be laundry liquid pods.

The term "product-holding" is not necessarily intended to mean a blister actually holding a product, but may also refer to a blister capable of holding a product. Likewise the term "product-receiving" does not necessarily mean that a product is received in the blister, but that it can be.

According to embodiments of the invention, there is provided a lockable receptacle comprising a main body having one or more product-receiving blisters a second part of a stopping mechanism being disposed proximate a rear end thereof, and a supporting mechanism formed proximate to the second part of the stopping mechanism for ensuring proper co-operation of first and second parts of the stopping mechanism, wherein the supporting mechanism comprises one or more retention panels depending from the main body of the lockable receptacle.

It is envisaged and intended that the various aspects, embodiments, examples, features and alternatives set out in the preceding paragraphs, in the claims and in the description and drawings may be taken independently or in any combination thereof. For example, features described in connection with one embodiment are applicable to all embodiments unless there is incompatibility of features.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
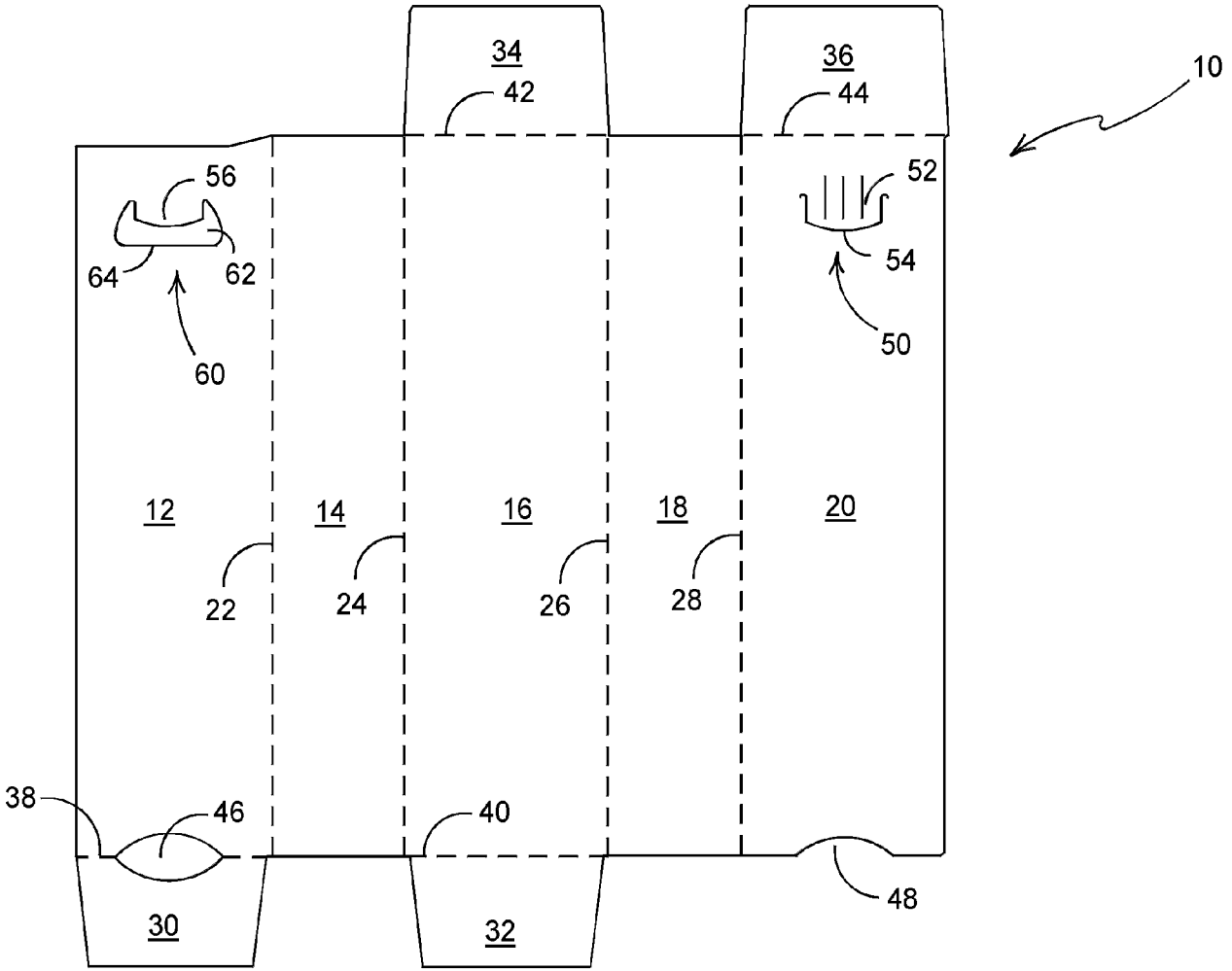
FIG. 1 is a plan view of a blank for forming an outer sleeve for use with a lockable receptacle in forming a package according to various embodiments of the invention.

Detailed descriptions of specific embodiments of the outer sleeves, lockable receptacles, packages and blanks are disclosed herein. It will be understood that the disclosed embodiments are merely examples of the way in which certain aspects of the invention can be implemented and do not represent an exhaustive list of all of the ways the invention may be embodied. Indeed, it will be understood that the outer sleeves, lockable receptacles, packages and blanks described herein may be embodied in various and alternative forms. The Figures are not necessarily to scale and some features may be exaggerated or minimized to show details of particular components. Any specific structural and functional details disclosed herein are not to be interpreted as limiting, but merely as a basis for the claims and as a representative basis for teaching one skilled in the art to variously employ the invention.

The Figures and detailed description are provided to describe and illustrate examples in which the disclosed package and its parts may be made and used, and are not intended to limit the scope thereof. Those skilled in the art will readily appreciate that the disclosed packages can be used to store a variety of products. More specifically, the disclosed lockable receptacles can be used for the storage of products such as, for example, detergents and other cleaning agents for use in washing machines, dishwashers and the like in "pod" or large-size capsule form, healthcare or pharmaceutical products, garden products, smokeless tobacco, cigarettes, food-items (for example loose leaf tea and coffee pods), confectionary, toys, electrical items or any product stored in a pouch, blister or compartment, and the like, without departing from the inventive aspects of the present disclosure.

According to some embodiments of the invention, a package may include an outer sleeve 110 (see FIGS. 3, 4, 5, 5A and 6); a lockable receptacle 70 (see FIGS. 2A, 2B, 4, 5, 5A and 6); and a stopping mechanism 30/74 for restricting or preventing a lockable receptacle 70 from being fully withdrawn from the outer sleeve 110. More specifically, a brace-style supporting mechanism 80*a*, 80*b* that improves the effectiveness or ensures proper operation of a stopping mechanism 30/74 may be employed with a package. In some embodiments, the stopping mechanism 30/74 may comprise two primary parts: a first part 30 which is provided at an open front end of the outer sleeve 110, and a second part 74 which is provided by the lockable receptacle 70.

Additional embodiments of a package may include a two-part complementary locking mechanism 60/74 for locking the lockable receptacle 70 in a fully inserted position within the outer sleeve 110 (also referred to as a closed position). A package may also include a release mechanism 50 for unlocking the two-part locking mechanism. The two-part locking mechanism may provide an optional child-resistant feature.

A brace-style supporting mechanism 80, such as retention panels 80*a*, 80*b* may be utilized with a variety of package arrangements according to various embodiments of the invention, wherein a lockable receptacle 70, particularly one having deep-fill blisters 78*a*, 78*b*, 78*c*, is slidably moveable into and out of an outer sleeve 110 and yet remains locked or engaged with the front end 30 of the outer sleeve 110 to prevent its complete withdrawal from the outer sleeve 110. Such packages may be beneficial in applications where repeated use of the package is required to individually dispense, over a period of time, items contained in deep-fill blisters 78*a*, 78*b*, 78*c* provided on or as part of the lockable receptacle 70.

In some embodiments of the invention, a two-part locking mechanism 60/74 enables packages to be utilized in applications where child-resistance is required or desired (for example where the items contained in the blisters 78*a*, 78*b*, 78*c* of the lockable receptacle 70 are potentially harmful or toxic, such as cleaning agents). However, the application of a brace-style supporting mechanism 80*a*, 80*b* is not so limited and such may be used in other forms of packaging, such as secure packaging for high-value and/or delicate products.

A lockable receptacle 70 having a brace-style supporting mechanism 80 according to embodiments of the invention is illustrated in FIGS. 2A, 2B, 2C, 4, 5, 5A and 6. The lockable receptacle 70 is optionally primarily formed from plastics material. The lockable receptacle 70 has a main body 72 that is fully receivable and retainable within an outer sleeve (such as an outer sleeve 110 formed from a blank 10 shown in FIG. 1 and described below). The lockable receptacle 70 may include a series of product-holding blisters 78*a*, 78*b*, 78*c*, each for retaining a single product or single portion of a product. Optionally, and by way of exemplary illustration only, the lockable receptacle 70 comprises three product-holding blisters 78*a*, 78*b*, 78*c* arranged in a 3×1 array. The blisters 78*a*, 78*b*, 78*c* are optionally molded (for example blow molded or press-molded) out of the main body portion 72. A perforable or peelable sealing film (not shown) is affixable, optionally by means of adhesive or other bonding agent, to a flanged part of the main body 72 that surrounds open tops 84*a*, 84*b*, 84*c* of the blisters 78*a*, 78*b*, 78*c* (see FIG. 2B). The blisters 78*a*, 78*b*, 78*c* optionally each have tapered sides and a base portion 82*a*, 82*b*, 82*c* respectively. The base portions 82*a*, 82*b*, 82*c* slide along a floor of the outer sleeve 110 that is provided by a bottom panel 16.

The lockable receptacle 70 may include a second part 74 of the two-part complementary mechanical locking mechanism 60/74 and the second primary part 74 of the two-part stopping mechanism 30/74. The two-part stopping mechanism 30/74 beneficially enables a user to withdraw the lockable receptacle 70 from the outer sleeve 110 only to a limited extent to prevent the lockable receptacle 70 from becoming completely separated from the outer sleeve 110. This avoids a user having to re-insert the lockable receptacle 70 within the outer sleeve 110 and more easily enables the lockable receptacle 70 to be slid back into the outer sleeve 110 to return to its fully inserted closed position.

Figure 2A:
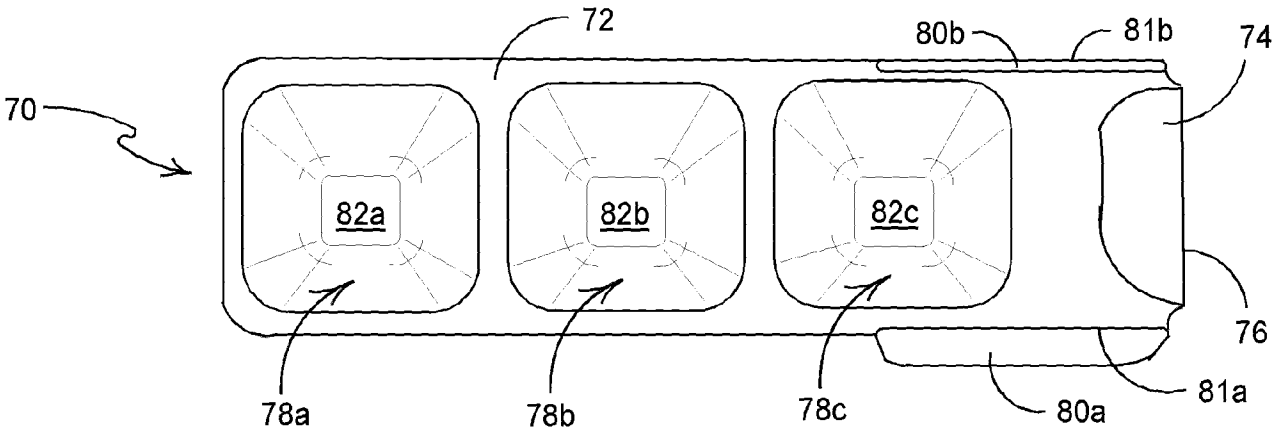
FIG. 2A is a plan view of the top of a lockable receptacle for use with an outer sleeve formed from the blank of FIG. 1.
Figure 2B:
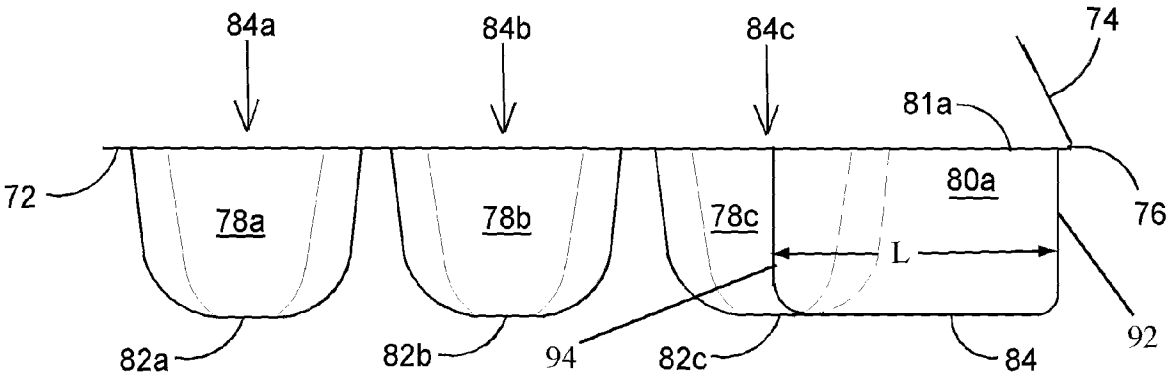
FIG. 2B is a side elevation of a lockable receptacle including a second part of a two-part locking mechanism, a series of three deep-fill blisters each for holding an item, and a brace-style supporting mechanism.
Figure 2C:
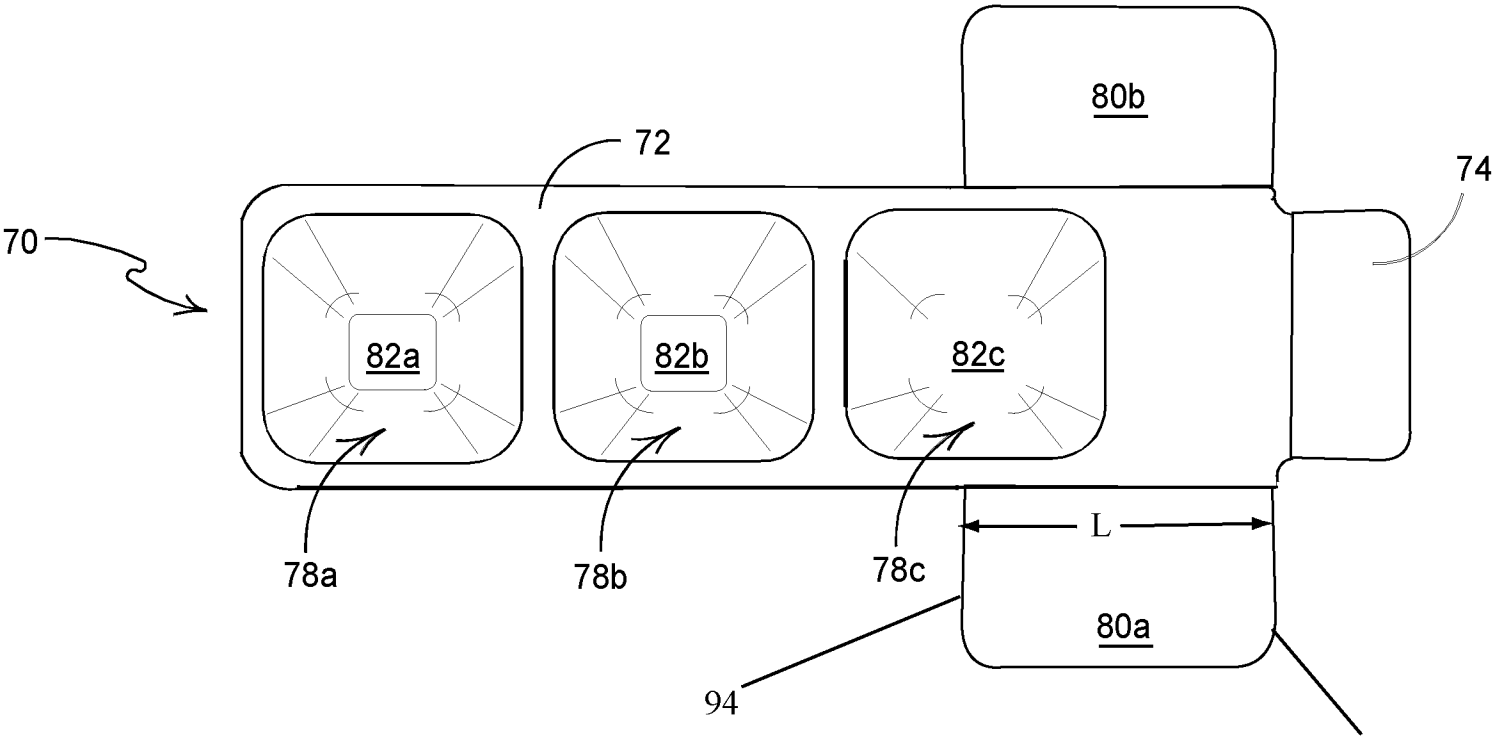
FIG. 2C is a plan view of the top of a lockable receptacle according to various embodiments of the invention illustrating a configuration of a supporting mechanism and locking feature.

The second part 74 of the two-part complementary mechanical locking mechanism 60/74 and the second primary part 74 of the two-part stopping mechanism 30/74 are optionally provided by a single component on the lockable receptacle 70. The second part 74 may also be referred to herein as the locking tail flap 74 or locking foot 74. The lockable receptacle 70 is optionally formed as a unitary one piece plastics molded construct and the locking foot 74 is integrally formed therewith. The locking foot 74 may be connected to the main body portion 72 by means of a hinge connection, which in this embodiment is optionally a living hinge 76 (see FIG. 2B) allowing the locking foot 74 to be molded as shown in FIG. 2C and then folded to produce the locking foot 74 illustrated in FIG. 2A.

To ensure proper engagement of the locking foot 74, particularly with the first primary part 30 of the two-part stopping mechanism 30/74, but also optionally with the first part 60 of the two-part complementary locking mechanism 60/74, a supporting mechanism 80 is provided. In some embodiments, the supporting mechanism 80 comprises two side panels or retention panels 80*a*, 80*b* formed as planar panels hingedly connected to the main body 72 of the lockable receptacle 70. Each side panel 80*a*, 80*b* is hinged by means of a hinge connection 81*a*, 81*b* respectively. In such arrangement, the hinge connections 81*a*, 81*b* may be living hinges formed in the plastics material from which the lockable receptacle 70 is formed. Portions of the retention panels 80*a*, 80*b* are disposed in the region immediately below at least part of the locking foot 74 when the locking foot 74 is folded about its living hinge 76. Each retention panel 80*a*, 80*b* may have a depth that is about equal to the depth of the outer sleeve 110 and each retention panel 80*a*, 80*b* may brace between the locking foot 74 and floor 16 of the outer sleeve 110 as a supporting strut.

The product-holding blisters 78*a*, 78*b*, 78*c* (also referred to as product-receiving blisters particularly when no product is present) may be identical in their size and shape having a top opening 84*a*, 84*b*, 84*c* that is a uniform square-shape with rounded corners. The rear-most product-holding blister 78*c* may have an opening 84*c* that is the same shape as the openings 84*a*, 84*b* of the product-holding blisters 78*a*, 78*b*.

In some other embodiments, the supporting mechanism 80 may include only one retention panel 80*a* or 80*b*. Preferably however, the supporting mechanism 80 includes two or more retention panels 80*a*, 80*b* that each depend from the main body portion 72 and extend between the plane of the main body portion 72 and a plane containing the bottoms 82*a*, 82*b*, 82*c* of the product-holding blisters 78*a*, 78*b*, 78*c*. In other words, it is preferred that the maximum depth of the retention panels 80*a*, 80*b* is about equal to (or only slightly less than) the maximum depth of the product-holding blisters 78*a*, 78*b*, 78*c*. This enables the retention panels 80*a*, 80*b* to act as struts or braces to ensure a good engagement between the locking foot 74 and the first part 30 of the two-part stopping mechanism 30/74. Additionally, the retention panels 80*a*, 80*b* acting as braces and supports may optionally ensure good engagement between the locking foot 74 and the first part 60 of the two-part locking mechanism 74/60. This is described further below with reference to FIGS. 6 and 7.

Each retention panel 80*a*, 80*b* may have a length that is preferably, but not necessarily, the same length as the other retention panel 80*b*, 80*a*. Referring to FIG. 2B, each retention panel 80*a*, 80*b* optionally has a length "L" such that the rear end 92 of that retention panel it extends from is located at a position close to the living hinge 76 between the main body 72 and below the locking foot 74; and the front end 94 of that retention panel is located at a position alongside the rear-most blister 78*c*. Stated differently, the front end 94 of each retention panel is positioned such that each retention panels overlaps at least a part of the rear-most blister 78*c* as viewed in FIG. 2B which is a side elevation of the lockable receptacle. The length "L" of each retention panel 80*a*, 80*b* may be between about 3 cm and 7 cm and preferably may be about 6 cm.

As illustrated in FIG. 2C, a main body 72 of a lockable receptacle 70 may include retention panels 80*a* and 80*b*. When molded, retention panels 80*a* and 80*b* may be in the same plane as a top surface of the main body 72 as illustrated in FIG. 2C. The retention panels 80*a* and 80*b* may be folded downward to form the supporting mechanism 80 illustrated in FIGS. 2A and 2B.

Turning now in more detail to the outer sleeve 110, reference is made to FIG. 1, wherein the blank 10 for forming the outer sleeve 110 is illustrated. The blank 10 is formed of a foldable substrate, for example paperboard, optionally having at least one coated and printed side. In other embodiments, the blank 10 may be formed from any one or a combination of: paper, paperboard, fiberboard, plastics material, coated material, uncoated material and printed material. Optionally in the present embodiment, the blank 10 is a sheet of paperboard having a polymer based tear resistant coating on one side thereof, for example the blank 10 may be formed from Printkote® EasySeal Plus paperboard.

A blank 10 may include, in series: an inner top panel 12, a first side panel 14, a bottom panel 16, a second side panel 18, and an outer top panel 20, hinged one to the next by means of longitudinally extending fold lines 22, 24, 26 and 28 respectively.

Rear end flaps 34, 36 are hinged by fold lines 42, 44 to the "rear" ends of the bottom panel 16 and outer top panel 20. These rear end flaps 34, 36, in use, are folded approximately 90° about fold lines 42 and 44 and are affixed in face contacting relationship to one another to form a composite end wall 34/36 for the outer sleeve 110 (see FIGS. 5, 5A and 6). The composite end wall 34/36 may be referred to herein as a "rear end wall".

A first front end flap 30 and an optional second front end flap 32 are hinged by fold lines 38 and 40 to the "open" ends of the inner top panel 12 and bottom panel 16 respectively. Fold line 38 is optionally interrupted by an aperture 46 which provides a recess by which a user can grasp a portion of the lockable receptacle 70 to assist in sliding it from the closed position into an open or partially open position. The first and second end flaps 30, 32, in use, are folded approximately 180° about fold lines 38 and 40. The first front end flap 30 is not necessarily affixed to the inside surface of the inner top panel 12, whereas the second front end flap 32 preferably is affixed in face contacting relationship to the bottom panel 16. Once folded and formed in this way, the first and second end flaps 30, 32 each optionally serve to provide a smooth finish to the "open" end of the outer sleeve 110, and the first end flap 30 serves as the first part of the stopping mechanism provided for preventing or at least mitigating against the complete withdrawal and separation of the lockable receptacle 70 from the outer sleeve 110.

The blank 10 also comprises elements for forming the first part 60 of the two-part locking mechanism 74/60. The elements include: an aperture 62 and a first edge 64 formed in the inner top panel 12 (the first edge 64 being defined by the aperture 62). The aperture 62 may be considered as a recess into which, in use in the locked configuration, the locking tail foot 74 may be at least partially inserted as its free edge (the edge opposite to the hinge connection 76) abuts, engages or otherwise connects with the locking edge 64. The blank 10 further comprises elements for forming the release mechanism denoted generally by reference 50. The elements for forming the release mechanism 50 optionally include: an outer moveable tab 52 formed in the outer top panel 20; and an inner tab 56 formed in the inner top panel 12. Each moveable tab 52, 56 is preferably, but nevertheless optionally, integrally formed within the blank 10. Each moveable tab 52, 56, comprises an anchored portion and a free edge which is defined by a cut or other frangible connection such that the free edge is separated from the remainder of the outer top panel 20 and inner top panel 12 respectively. The moveable tabs 52, 56 are thereby moveable below the plane of the panel from which they are formed (the outer top panel 20 and inner top panel 12 respectively). Optionally, the outer moveable tab 52 formed in the outer top panel 20 is the same width as the innermost moveable tab 56 in the inner top panel 12.

The outer moveable tab 52 may be defined by a first side edge, a second side edge and a front edge 54 (which may in some embodiments be frangibly connected to the outer top panel 20 until its first use is required). The first and second side edges are optionally substantially parallel to one another and each terminate in an acutely radiussed arcuate cut line termination to prevent the further propagation of the cut side edges into or through the outer top panel 20. The front edge 54 spans between and terminates in the first and second side edges. In this way a generally "U"-shaped moveable tab 52 is defined. The roughly "U"-shaped moveable tab 52 is preferably, but nevertheless optionally, disposed in a substantially medial position within the outer top panel 20.

Turning in more detail to the construction of the outer sleeve 110 from the blank 10, the blank 10 may be oriented so that its uncoated, unprinted side faces out. Optionally, the first and second end flaps 30, 32 are folded about fold lines 38, 40 and optionally only the second front end flap is affixed to the inside face (non-printed face) of the bottom panel 16. To affix the second end flap 32 to the bottom panel 16 adhesive (such as hot melt glue) may be applied to one or both of the second end flap 32 and the bottom panel 16. Then, the inner top panel 12 together with the first side panel 14 may be folded about fold line 24 to bring the inner top panel 12 and first side panel 14 into face contacting relationship with the inside faces of the bottom panel 16 and second side panel 18 respectively. Optionally, adhesive may be applied to parts of the inner top panel 12 and/or to parts of the outer top panel 20. The outer top panel 20 is then folded about fold line 28 to bring it into face-contacting relationship with the inner top panel 12 such that the outer top panel 20 and the inner top panel 12 are affixed together. At this point, construction of the outer sleeve 110 is not entirely completed since the rear end wall 34/36 has not been assembled. In this state, however, the outer sleeve 110 is in a flat form (not shown). It has been folded and part assembled and it is in this flat form that the outer sleeve 110 would preferably be shipped to a converting plant. As such, construction of the outer sleeve 110 may be fully completed at a converting plant, where the outer sleeve 110 is opened into a tubular form, loaded from one or both of the open (front) or rear ends with a product-holding lockable receptacle 70. Then, the rear end wall 34/36 is constructed by folding the rear end panels 34, 36 about fold lines 42, 44 and into affixed and face contacting relationship. Preferably, the bottom rear end flap 34 is folded first and the top rear end flap 36 is affixed thereto.

Figure 3:
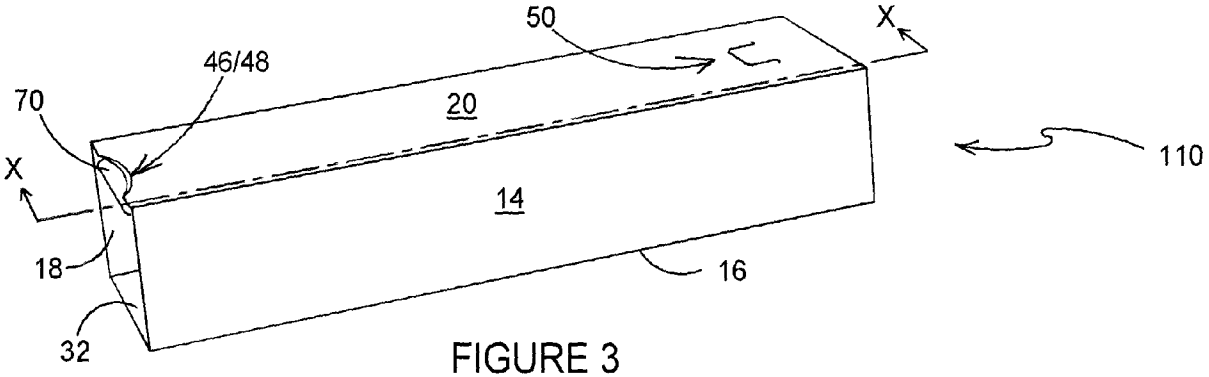
FIG. 3 is a perspective view of a package according to various embodiments of the invention.
Figure 5:
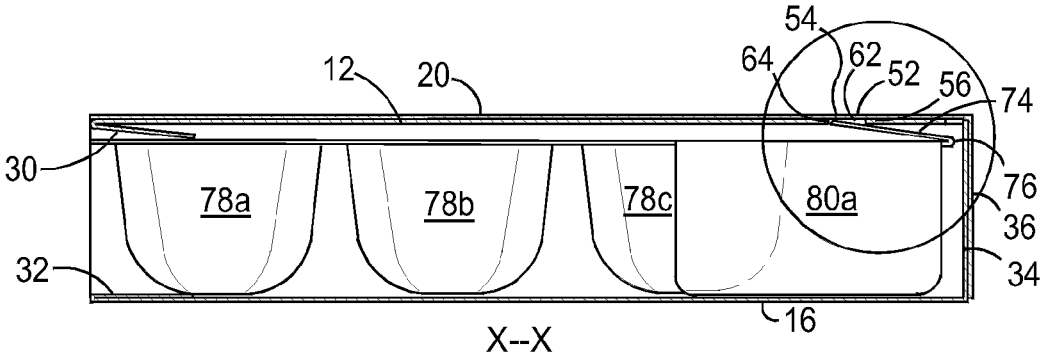
FIG. 5 is a cross-sectional view, taken along the line XX, of the closed package of FIG. 3, in which it is shown how the first part of a two part-locking mechanism interacts with a second part provided on a lockable receptacle to lock a lockable receptacle within an outer sleeve.
Figure 5A:
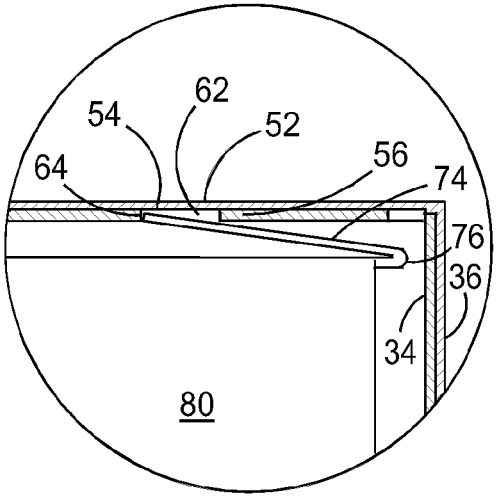
FIG. 5A is an enlarged view of the rear closed end of the package shown in cross-section in FIG. 5.

Optionally, in some embodiments, the lockable receptacle 70 is loaded through the open front end, after the rear end wall 34/36 has been constructed. To install the lockable receptacle 70 into the outer sleeve 110, the locking foot 74 is folded toward the main body 72 and optionally, in this form, the lockable receptacle 70 is slidably pushed into the outer sleeve 110, leading with the hinge connection 76, through the open front end and towards the closed rear end wall 34/36. The package in a closed configuration is shown in FIG. 3. The lockable receptacle 70 is automatically locked in the closed configuration within the outer sleeve 110 by operation of the two-part complementary locking mechanism 74/60. This is best illustrated in FIG. 5A, wherein it can be seen that, due to the natural resilience of the material from which the locking foot 74 and/or lockable receptacle 70 is at least in part formed, the folded locking foot 74 unfolds slightly, into the gap or recess provided by the aperture 62. In this way, the locking foot 74 catches on the locking edge 64 provided by the internal face of the cut locking edge 64.

Once the outer sleeve 110 is assembled, the release mechanism 50 is also formed. As can also be seen in FIG. 5A, the moveable tab 52 is disposed in at least partial super position above the moveable tab 56 and is disposed in registry with the aperture 62 such that the outer tab 52 can be depressed into the aperture. Optionally in conjunction with tab 56, the outer tab 52 can be used to dislodge the locking foot 74 out of engagement with the recess 62 and locking edge 64. Simultaneously, the lockable receptacle 70 can be withdrawn from the outer sleeve 110. The thumb recess 46/48 may assist a user in grasping the lockable receptacle 70, when it is disposed fully within the outer sleeve 110, in order to withdraw it from the outer sleeve 110. In dependence upon the extent to which the lockable receptacle 70 is withdrawn from the outer sleeve 110, access to one or more or all of the product-holding blisters 78*a*, 78*b*, 78*c* can be gained. As such it will be realized that a user is required to hold the package in one hand and with that same hand, depress the moveable tab 52, whilst at the same time, gripping and pulling an end edge of the lockable receptacle 70 with their other hand. This requires a degree of dexterity and provides a child-resistant locking mechanism.

Figure 4:
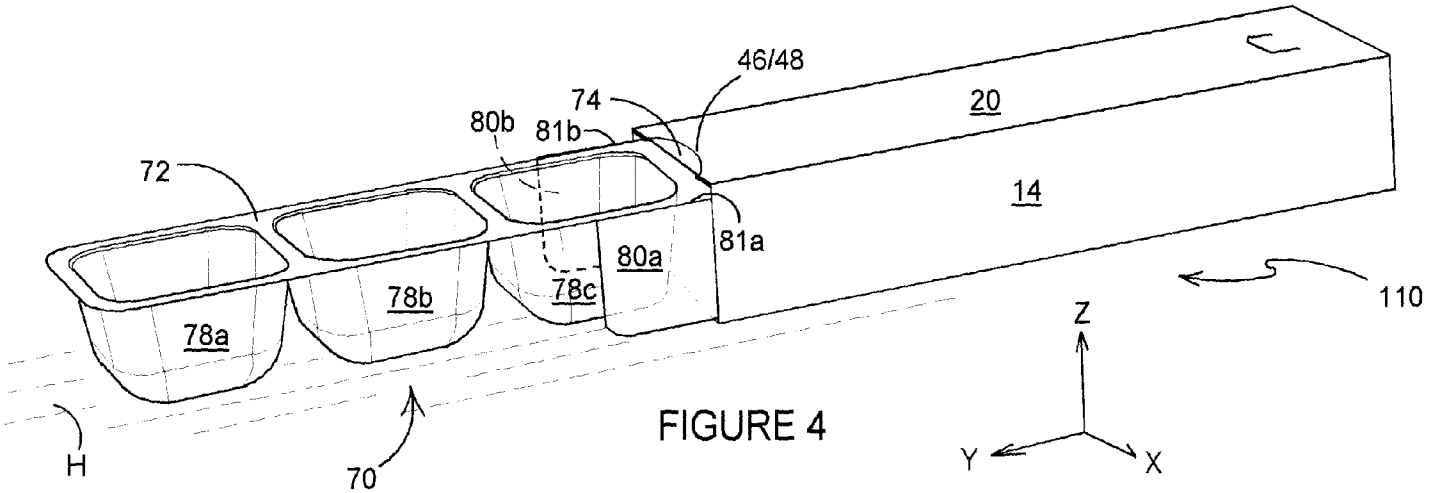
FIG. 4 is a perspective view of a package according to various embodiments of the invention.

Withdrawal of the lockable receptacle 70 is shown in perspective view in FIG. 4, wherein a notional horizontal plane in which the bases 82*a*, 82*b*, 82*c* of each product-holding blisters 78*a*, 78*b*, 78*c* and the lower edges of the retention panels 80*a*. 80*b* rest. As is best viewed in FIG. 6, in the fully withdrawn position, the stopping mechanism 30/74 acts to prevent the lockable receptacle 70 from becoming fully separated or detached from the outer sleeve 110. The locking foot 74 catches between the ceiling of the outer sleeve 110 (provided by the inner top panel 12) and the first end flap 30. Optionally, the locking foot 74 and first end flap 30 are sized such that at the full extent of the permitted travel of the lockable receptacle 70, the leading edge of the locking foot 74 abuts or contacts the hinge connection 38 between the first end flap 30 and the inner top panel 12. As such a portion of the lockable receptacle 70 having a length substantially equal to the locking foot 74 remains within the outer sleeve 110 (see FIG. 4 and FIG. 6).

The product-holding blisters 78*a*, 78*b*, 78*c* are of a deep-fill form to accommodate larger sized articles, such as laundry detergent pods. The blisters 78*a*, 78*b*, 78*c* optionally have a depth which is about 10 times greater than the depth of blisters typically used in such sleeve-and-drawer style packages for use with pharmaceutical products such as relatively small tablets and capsules. Optionally, the depth of the product-holding blisters 78*a*, 78*b*, 78*c* may be about 3 cm to about 5 cm and preferably about 3.5 cm. The outer sleeve 110 is dimensioned such that it is only slightly larger than the lockable receptacle 70 such that the lockable receptacle 70 is accommodated therein in a relatively close-fitting manner. As such the lockable receptacle 70 is constrained laterally (in the x-direction) by the first and second side walls 14, 18 and is constrained longitudinally (in the y-direction) by the rear end wall 34/36 and the two-part locking mechanism 60/74. The lockable receptacle 70 is further constrained in the direction of a z-axis of the outer sleeve 110 by the top wall 12/20 and the bottom panel 16 and because the depth of the outer sleeve 110 (defined as the distance between the inner ceiling provided by the inner top panel 12 and the inner floor provided by the bottom panel 16) is only slightly greater than the depth of the lockable receptacle 70 (i.e. the depth of the product-holding blisters 78*a*, 78*b*, 78*c*).

Figure 6:
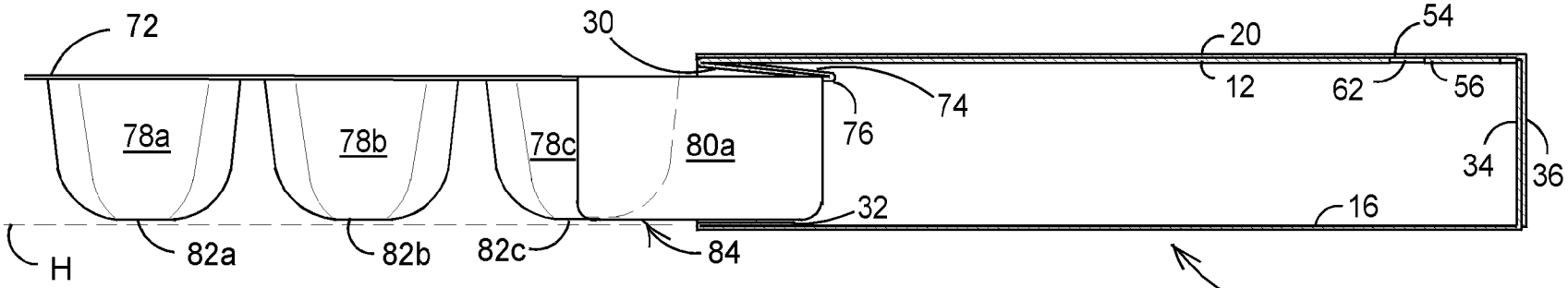
FIG. 6 is a cross-sectional view of a package according to various embodiments of the invention.
Figure 7:
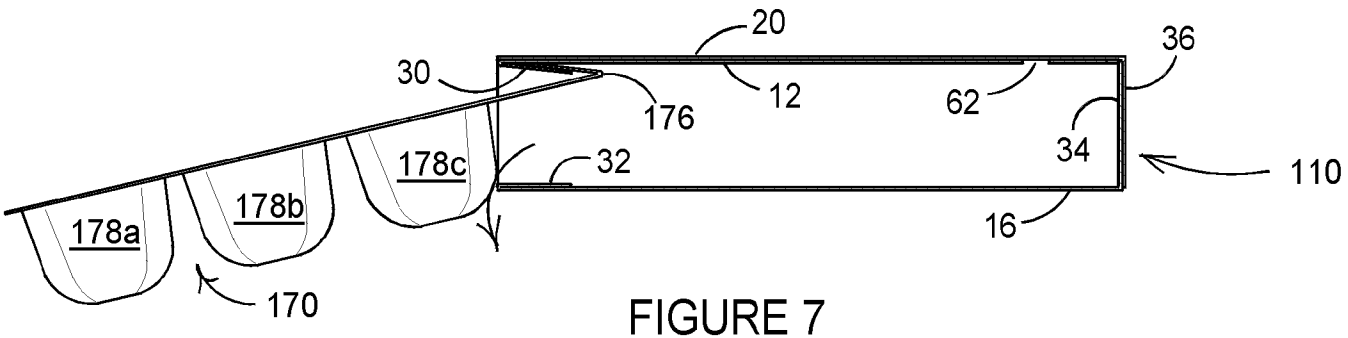
FIG. 7 is a cross-sectional view of a similar package to that shown in FIG. 6, wherein a lockable receptacle not having a supporting mechanism according to embodiments of the present invention is disposed in a fully extended position in which the lockable receptacle is withdrawn to such an extent that access to all blisters is possible, however, the lockable receptacle does not remain locked and anchored to the outer sleeve, the stopping mechanism is failing and the lockable receptacle is shown disadvantageously falling out of the outer sleeve.

As shown in FIG. 6, a supporting mechanism 80 may provide a support approximately beneath the locking foot 74 to ensure that the locking foot 74 can maintain a sufficiently strong engagement with the first part of the stopping mechanism 30 (and optionally additionally with the first part of the locking mechanism 60). The retention panels 80*a*, 80*b* may prevent the distortion of the lockable receptacle and/or the bending down of the locking foot 74 (which would release the locking foot from engagement with the first part of the stopping mechanism 30 and/or the first part of the locking mechanism 60). Reference is made to FIG. 7 wherein the benefit provided by the supporting mechanism 80 is further illustrated in respect of a lockable receptacle 170 that does not form part of the claimed invention and does not have a supporting mechanism 80. As can be seen in FIG. 7, because such a lockable receptacle 170 has deep-fill blisters 178*a*, 178*b*, 178*c* and is unsupported in the region below the locking foot, the lockable receptacle 170 can tilt as it reaches its fully extended position. The angled position of such a lockable receptacle 170 compromises the operation of the stopping mechanism and the locking foot can become disengaged from the first front flap 30. Disadvantageously therefore such a lockable receptacle 170 easily can become completely separated from the outer sleeve 110. Advantageously however, the present invention mitigates against such a problem by the provision of a supporting mechanism 80—for example in the form of retention panels 80*a* and 80*b*—provided to ensure that the lockable receptacle 70 remains constrained in the direction of a z-axis of the outer sleeve 110 by the top wall 12/20 and the bottom panel 16. The supporting mechanism 80 resists any forces placed upon the part of the lockable receptacle 70 that is disposed outside the outer sleeve 110 (see FIG. 6) that could cause rotation of the lockable receptacle 70 and thereby disengagement of the stopping mechanism 30/74. The supporting mechanism 80 maintains the part of the lockable receptacle 70 that is disposed inside the outer sleeve 110 (when the lockable receptacle 70 is in the fully extended position) and maintains the part of the lockable receptacle 70 that is disposed outside the outer sleeve 110 in a level position, wherein the bases 82*a*, 82*b*, 82*c*, 84 of all of the blisters 78*a*, 78*b*, 78*c*, 80 rest in the same notional horizontal plane H. Beneficially, the provision of the supporting mechanism 80 in the form of an integrally formed and folded panel requires only a little additional material and requires only two simple additional folding steps to be carried out to assemble the lockable receptacle 70. As such the present invention provides a low cost solution that ensures consistent repeated opening and closing of the sleeve-and-drawer style package.

While the present invention has been described in terms of specific embodiments thereof, it will be understood that no limitations are intended thereby to the details of construction or design, the present invention contemplating and including any novel feature or novel combination of features which are herein disclosed.

It can be appreciated that various changes may be made within the scope of the present invention, for example, the size, number, configuration, position and relative placement, shape and physical formation of the or each product-holding blister, supporting mechanism or retention panel, the locking structure and the moveable tabs of the release mechanism may be adjusted to suit the intended purpose of the package.

Figure 8:
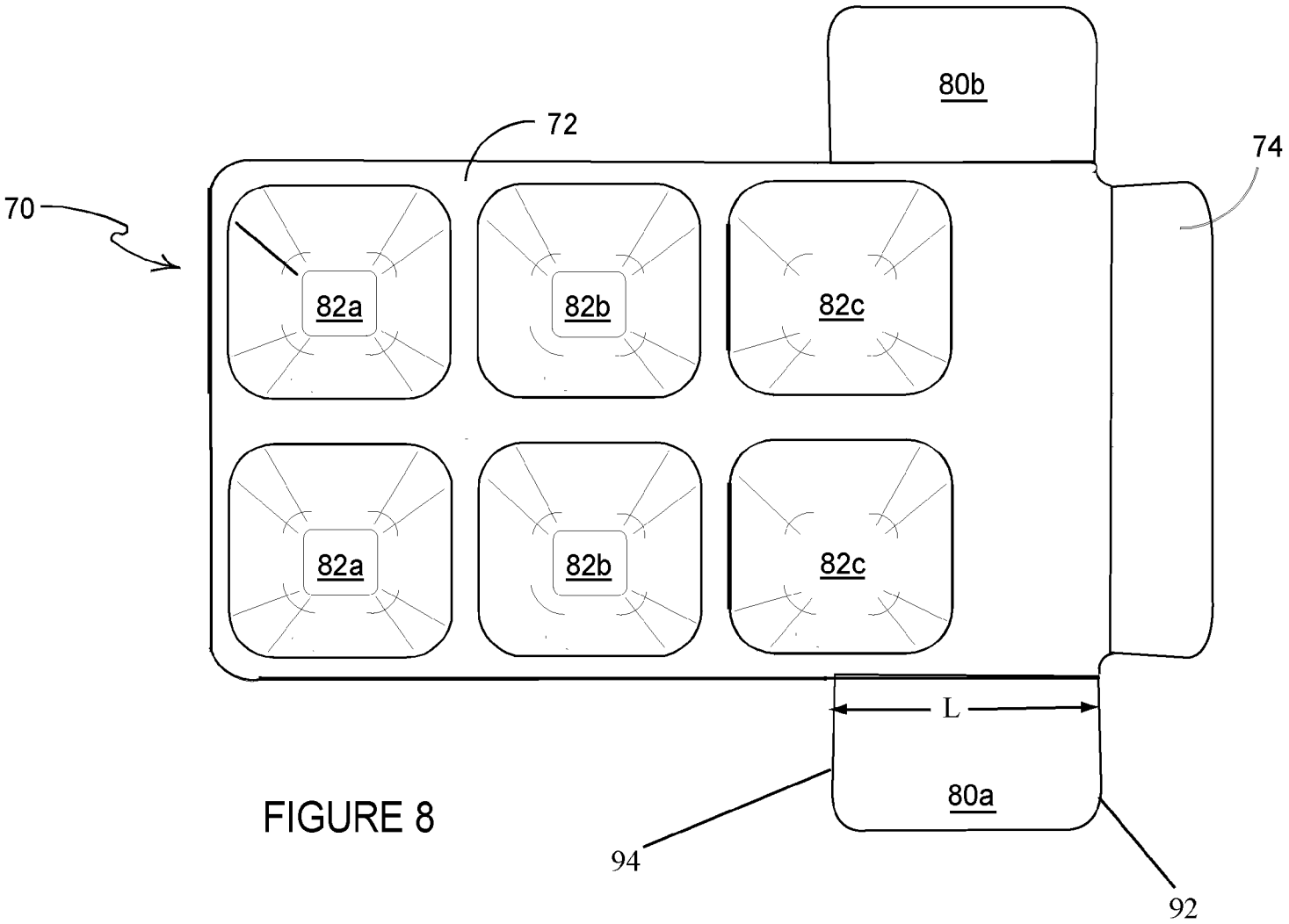
FIG. 8 is a plan view of a package according to various embodiments of the invention.

The lockable receptacle 70 may be used in conjunction with other styles of outer sleeve. For example, in other envisaged embodiments, the outer sleeve may be a plastics two-part construction rather than a folded paperboard construction. In other embodiments, other number and configuration of product-holding blisters are provided, for example in other envisaged embodiments, the product-holding blisters are arranged in a 2×3 array as illustrated in FIG. 8.

In other embodiments, the lockable receptacle may comprise two parts: a first blister portion comprising the product-holding blisters; and a second slide card portion which is attached to the first blister portion and which provides the second part of a two-part complementary locking mechanism in the form of a foldable locking tail flap. In such an arrangement, the retention panels may be provided by the second slide card rather than by plastics material added to the blister portion.

In some embodiments wherein the locking receptacle comprises blisters in an arrangement of more than one blister wide, for example, in a 3×3 arrangement of product-holding blisters, the retention panels 80*a*, 80*b* may remain on the outside edges of the lockable receptacle and provide sufficient support in that way. Alternatively, where a second slide card portion is provided one or more additional retention panels may be provided between the rows of product-receiving blisters 78*a*, 78*b*, 78*c*. In such embodiments, the blister portion of a lockable receptacle provides outermost retention panels 80*a*, 80*b* and a slide card provides one or more additional intermediate retention panels to provide a strut or support in between the outermost retention panels.

In other embodiments, the first end flap 30 may be similarly sized to the locking foot 74 such that the free edge of the first end flap 30 abuts or contacts the hinge connection 76 between the locking foot 74 and main body 72 of the lockable receptacle 70 at the same time as the free-edge of the locking foot 74 contacts the hinge connection 38.

In other embodiments, the supporting mechanism may be provided by more than one panel on each side, or by a retention panel that is not substantially rectangular. In yet further envisaged embodiments, the lower edge of the or each retention panel that rests may comprise a panel portion and may not simple be a cut edge, but may be formed as a runner or panel which would slide along and in contact with bottom panel of the outer sleeve. In other embodiments, the retention panel is not exactly equal in depth to the depth of the product-holding blisters or does not extend in line with the bases of the product-holding blisters but stops above the bottom panel of an outer sleeve a short distance such that rotation of the lockable receptacle is still minimized and sufficiently so as to prevent the locking foot disengaging from the first part of the stopping mechanism.

In other embodiments, the two-part locking mechanism and release mechanism illustrated herein is not provided. In such embodiments an alternative locking mechanism/release may be provided, for example a release mechanism utilizing a demarcated pressing zone rather than an outer moveable release tab may be used. Alternatively in still other embodiments, no locking mechanism and release mechanism is provided but the receptacle 70 is provided with a supporting mechanism 80 such as one or more retention panels 80*a*, 80*b*.

The arrangement of panels of the blank for forming the outer sleeve is different in other embodiments, indeed in some embodiments the outer sleeve may comprise a three-ply top wall.

It will be recognized that as used herein, directional references such as "top", "bottom", "front", "back", "end", "side", "inner", "outer", "upper" and "lower" do not necessarily limit the respective panels to such orientation, but merely serve to distinguish these panels from one another. Any reference to "hinged connection" should not be construed as necessarily referring to a single fold line only; indeed it is envisaged that hinged connection can be formed from one or more of the following: a short slit, a frangible line or a fold line without departing from the scope of the invention.

The phrase "in registry with" as used herein refers to alignment of two or more elements in an erected package, such as a moveable tab formed in an outer top panel and a moveable tab formed in an inner top panel. Those elements in registry with each other may be aligned with each other in the direction of the thickness of the overlapping panels.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A blister package, comprising:
an outer sleeve, comprising:
a closed rear end;
an open front end; and
a cavity between the rear end and front end;
a lockable receptacle, comprising:
a main body;
at least one blister formed in the main body;
a locking foot formed in the main body; and
a supporting mechanism formed separate from the locking foot and contiguously with the main body, comprising:
a first retention panel attached to the main body by a first living hinge; and
a second retention panel attached to the main body by a second living hinge;
wherein the supporting mechanism supports the lockable receptacle in the outer sleeve.

2. The blister package of claim 1, wherein the at least one blister formed in the main body comprises three blisters in a row.

3. The blister package of claim 1, wherein the at least one blister formed in the main body comprises a three-by-two array of blisters.

4. The blister package of claim 1, wherein the lockable receptacle is a unitary molded plastic structure.

5. The blister package of claim 1, further comprising a laundry liquid pod in each of the at least one blister.

6. A blister package, comprising:
an outer sleeve, comprising:
a closed rear end;
an open front end; and
a cavity between the rear end and front end;
a lockable receptacle in the outer sleeve, the lockable receptacle comprising:
a main body having a front end adjacent the open front end of the outer sleeve, a rear end adjacent the closed rear end of the outer sleeve, a first side and a second side;
a first blister formed in the main body and positioned adjacent the open front end of the outer sleeve;
a second blister formed in the main body and positioned adjacent the closed rear end of the outer sleeve;
a third blister formed in the main body and positioned between the first and second blister;
a locking foot hinged to the rear end of the main body;
a first retention panel hinged to the first side of the main body adjacent the second blister; and
a second retention panel hinged to the second side of the main body adjacent the second blister.

7. The blister package of claim 6, wherein the lockable receptacle comprises a lockable receptacle formed of a one-piece plastic molded construction.

8. The blister package of claim 6, wherein the first retention panel and the second retention panel have the same length L between about 3 cm and 7 cm.

9. The blister package of claim 6, wherein the first retention panel and the second retention panel each extend from the rear end of the main body towards the front end of the main body and at least partially overlap the second blister.

10. A molded receptacle for a package, comprising:
a main body having a front end adjacent the open front end of the outer sleeve, a rear end adjacent the closed rear end of the outer sleeve, a first side and a second side;
a first blister formed in the main body and positioned adjacent the open front end of the outer sleeve;

a second blister formed in the main body and positioned adjacent the closed rear end of the outer sleeve;

a third blister formed in the main body and positioned between the first blister and second blister;

a locking foot hinged to the rear end of the main body;

a first retention panel hinged to the first side of the main body adjacent the second blister; and a second retention panel hinged to the second side of the main body adjacent the second blister.

11. The molded receptacle of claim 10, wherein the first retention panel and the second retention panel have the same length L between about 3 cm and 7 cm.

12. The molded receptacle of claim 10, wherein the first retention panel and the second retention panel each extend from the rear end of the main body towards the front end of the main body and at least partially overlap the second blister.

* * * * *